United States Patent [19]

Jaeggi

[11] Patent Number: 4,583,327

[45] Date of Patent: Apr. 22, 1986

[54] RAIL GRINDING CAR

[75] Inventor: Hans P. Jaeggi, Lugano, Switzerland

[73] Assignee: Jackson Jordan, Inc., Ludington, Mich.

[21] Appl. No.: 555,275

[22] Filed: Nov. 25, 1983

[51] Int. Cl.[4] ..... E01B 31/17

[52] U.S. Cl. ..... 51/178

[58] Field of Search ..... 51/178, 273

[56] References Cited

U.S. PATENT DOCUMENTS

| | | | |
|---|---|---|---|
| 2,113,276 | 4/1938 | Moore | 51/178 |
| 2,779,141 | 1/1957 | Speno et al. | 51/178 |
| 3,358,406 | 12/1967 | Speno et al. | 51/178 |
| 3,526,997 | 9/1970 | Panetti | 51/178 |
| 3,606,705 | 9/1971 | Rivoire | 51/178 |
| 3,707,808 | 1/1973 | Danko et al. | 51/178 |
| 3,738,066 | 6/1973 | Panetti | 51/178 |
| 3,918,215 | 11/1975 | Scheuchzer | 51/178 |
| 3,945,152 | 3/1976 | Helgemeir | 51/178 |
| 4,020,599 | 5/1977 | Panetti | 51/178 |
| 4,050,196 | 9/1977 | Theurer | 51/178 |
| 4,115,857 | 9/1978 | Panetti | 51/178 |
| 4,135,332 | 1/1979 | Theurer | 51/178 |
| 4,178,724 | 12/1979 | Bruno | 51/178 |
| 4,189,873 | 2/1980 | Panetti | 51/178 |
| 4,205,494 | 6/1980 | Rivoire | 51/178 |

*Primary Examiner*—Roscoe V. Parker

*Attorney, Agent, or Firm*—Leydig, Voit & Mayer, Ltd.

[57] ABSTRACT

A railroad track rail grinding car having both vertical and horizontal grinding stones, with the horizontal stones being individually positionable to contact selected areas of a rail head profile and with the vertical stones being mounted on a flexible beam that can be bent to adjust the grinding path of the vertical stones. Both vertical and horizontal stones are surrounded with shrouds from which a vacuum pulls dust and sparks.

8 Claims, 16 Drawing Figures

RAIL GRINDING CAR

This invention relates generally to grinding for reforming railroad track rails and more particularly concerns an on-track rail grinding car.

The head surfaces of railroad track rails in direct contact with the wheels and wheel flanges of rolling stock tend to wear unevenly so that the cross sectional contour of the head becomes misshapen and the top surface of the rail becomes wavy, particularly on curved track. Most rolling stock is supported by pairs of flanged wheels mounted on a common axle. On a curve, inherently one wheel or the other is slipping on its rail, creating a frictional grinding action which, in time, deforms the track.

In the 1950's, axle loadings were greatly increased and train speeds also rose, making rail head wear a greater and greater problem. Tracks having particularly heavy usage, like those carrying unit coal trains through a number of curves, began requiring frequent replacement. Typically, wear would result in wave patterns in the top of the rail having wave lengths from ¼" to about one foot and amplitudes of a few thousandths of an inch. Rail contour could vary with metal mushrooming out 1/16" to 3/16". Such defects create undesirable vibration, particularly at high speeds, and also produce high noise levels.

As a remedy, techniques and machinery for grinding the rail heads have been suggested. On track grinding trains carrying arrays of heavy grinding stones powered by multi-horsepower motors have come into use. Horizontal grinding stones are generally annular with a flat, annular face being the grinding surface. Vertical grinding stones grind with the outer cylindrical surface of the stone. Vertical stones cut more rapidly but are more difficult to support in controlled positions.

Another problem with rail grinding cars is the generation of sparks, which can set fire to dried vegetation along the roadway, and the creation of very abrasive dust.

It is the primary aim of the present invention to provide an improved rail grinding car combining vertical grinding stones and horizontal grinding stones so that the characteristics of each are efficiently used.

It is also an object of the invention to provide a grinding car of the above type which embodies positioning control of an array of vertical grinding stones so that each stone properly engages the rail. A further object is to provide a car of the foregoing character in which the horizontal grinding stones are individually positionable to give great flexibility in grinding location and concentration.

Another object is to provide a car as characterized above that shields the grinding stones to contain and control dust and sparks, and to provide a safety factor against possible disintegration of one of the stones.

Other objects and advantages of the invention will become apparent upon reading the following detailed description and upon reference to the drawings, in which.

While the invention will be described in connection with a preferred embodiment, it will be understood that I do not intend to limit the invention to that embodiment. On the contrary, I intend to cover all alternatives, modifications and equivalents as may be included within the spirit and scope of the invention as defined by the appended claims.

Figure 1:
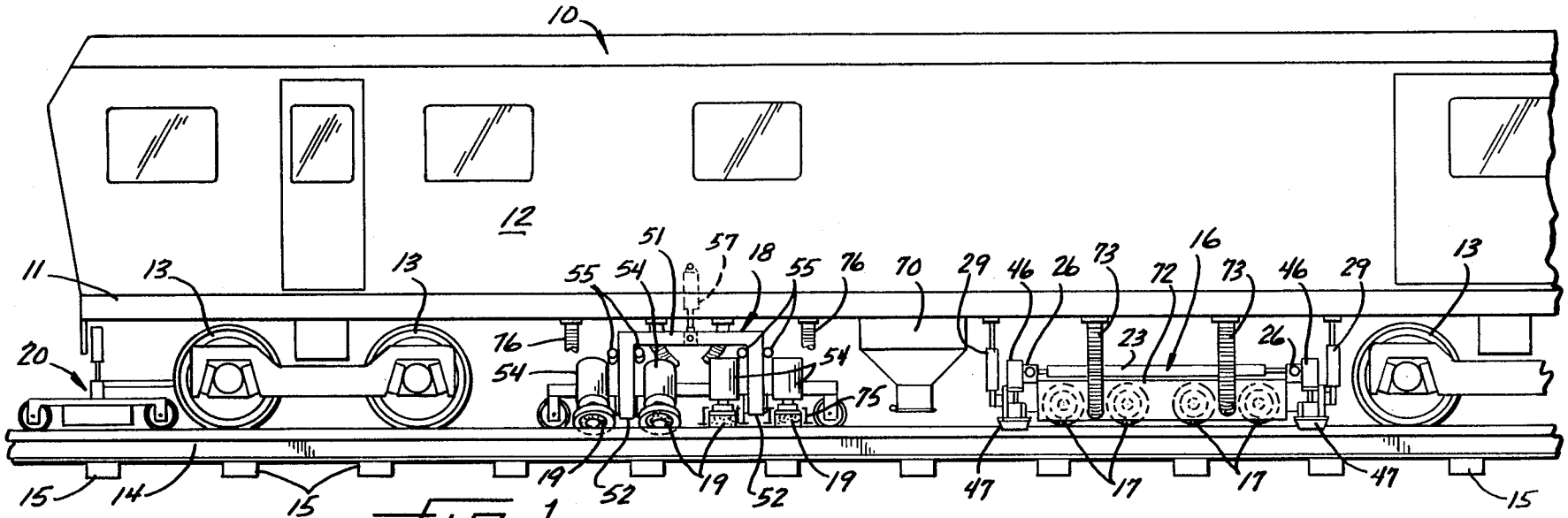
FIG. 1 is a side elevation of a railroad rail grinding car embodying the invention.

Turning now to the drawings, there is shown in FIG. 1 a railroad track rail grinding car 10 embodying the invention and including a frame 11 supporting a car body 12 and running on flanged wheels 13 engaging the track. The track includes the conventional rails 14 and ties 15. The car 10 carries a first subframe assembly 16 mounting an array of vertical grindng stones 17 for working on the top of a rail to level wave deformation, and a second subframe assembly 18 mounting an array of horizontal grinding stones 19 for working on the top contour of the head of the rails to restore rail head shape. At each end of the car 10 rail sensing and measuring units 20 are carried, although only one is shown. Each subassembly 16, 18 is, in effect, duplicated at opposite sides of the car 10 so that both rails 14 of the track are ground at the same time. Also, while only two sets of subassemblies 16, 18 are illustrated, it could be desirable to increase grinding capacity by lengthening the car 10 and doubling the number of subassemblies and grinding stones so that a total of 32 stones could be brought to bear on the rails.

Pursuant to the invention, the vertical stones 17, directly coupled to driving electric motors 21, are fixed to a flexible beam 22 with their axes of rotation canted from right angles of the rail 14 so that stone-rail contact is not perpendicular to the centerline of the rail head, and actuators 23 and 24 are provided to bend the beam 22 to adjust the grinding path defined by the stones 17 to the shape of the rail. Because the axes of the stones 17 are canted, there is straight line contact between stone and rail head, and the stones will wear evenly. If the stone axes were at right angles to the rail, the rail head shape would wear a concave groove into the stone periphery, and control and grinding accuracy would be lost.

Figure 2:
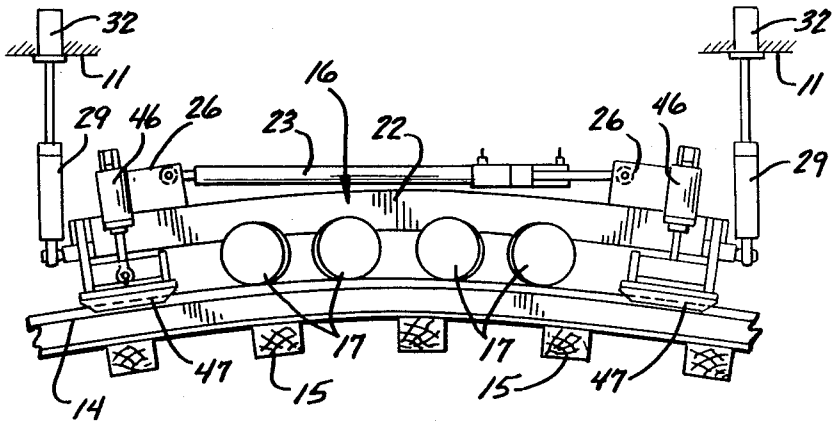
FIGS. 2 and 3 are side elevation and top plan of the array of vertical grinding stones, shown somewhat diagrammatically, mounted on the car of FIG. 1.
Figure 3:
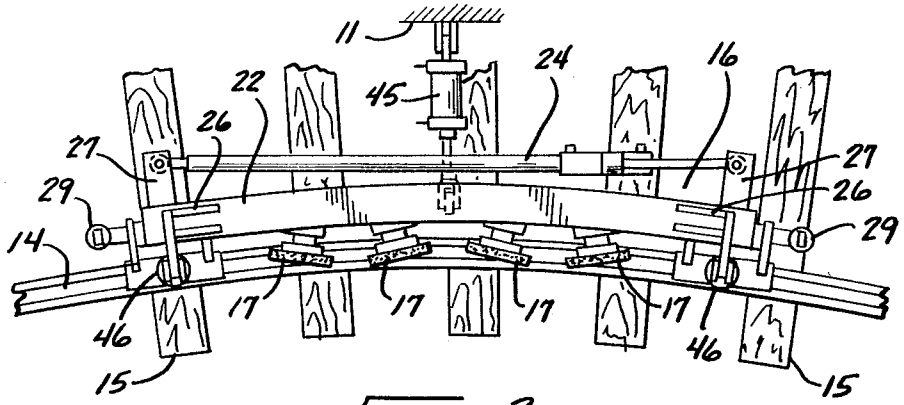

The actuator 23 is connected between lugs 26 at the top ends of the beam 22 and controls bending the beam in a vertical plane, and the actuator 24 is connected to lugs 27 at the side ends of the beam 22 and controls bending of the beam in a horizontal plane. Bending the beam curves the grinding path defined by the peripheries of the stones 17 so that the path can follow curves in the track. FIGS. 2 and 3 are greatly exaggerated and, in practice, a beam about 6' long would be bent only about 0.006" to conform with track curves.

Figures 4, 5:
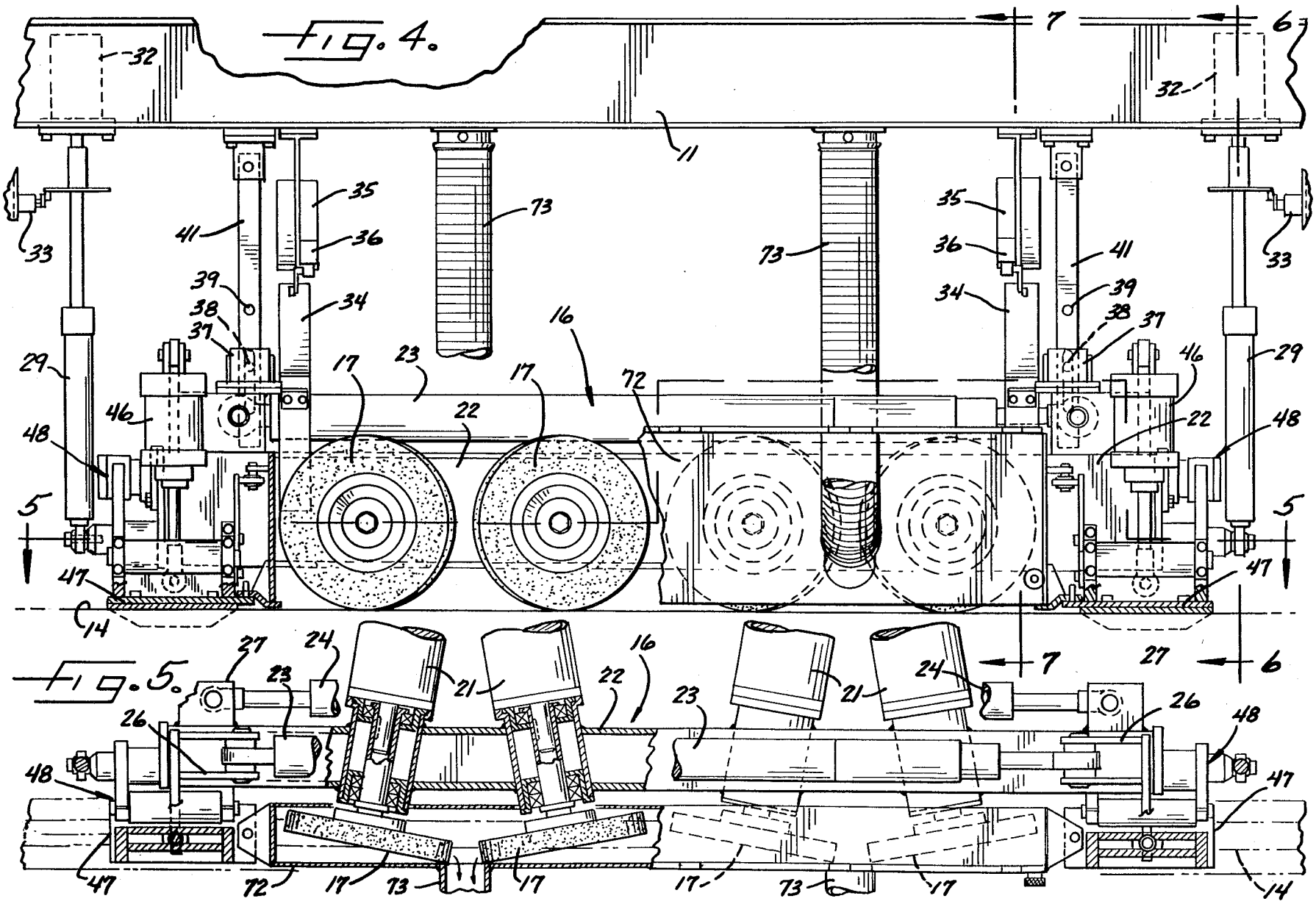
FIG. 4 is an enlarged side elevation of the vertical grinding stones shown in FIG. 1.
FIG. 5 is a partial section taken approximately along the line 5—5 in FIG. 4.
Figure 6:
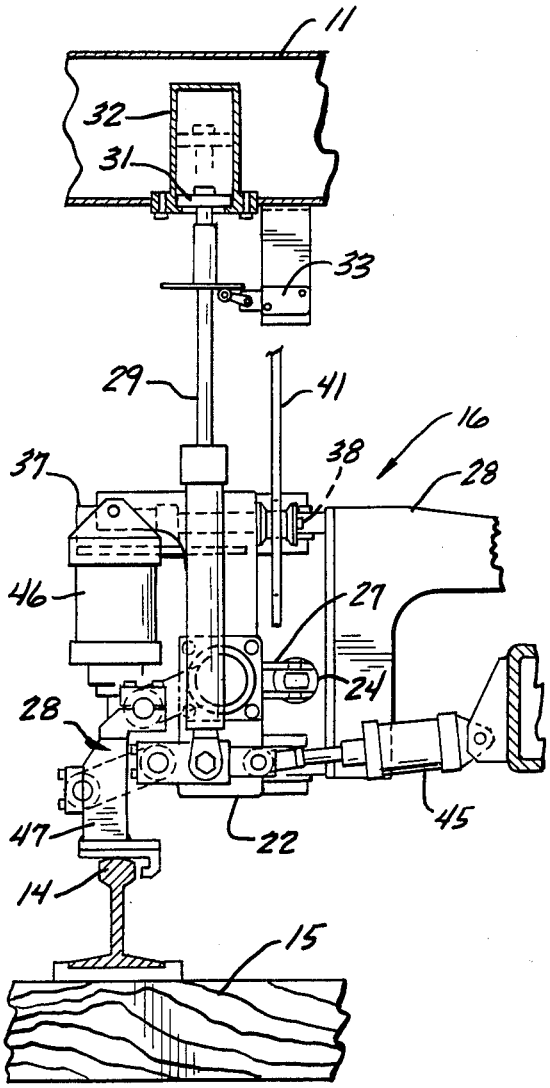
FIG. 6 is a partial section taken approximately along the line 6—6 in FIG. 4.
Figure 7:
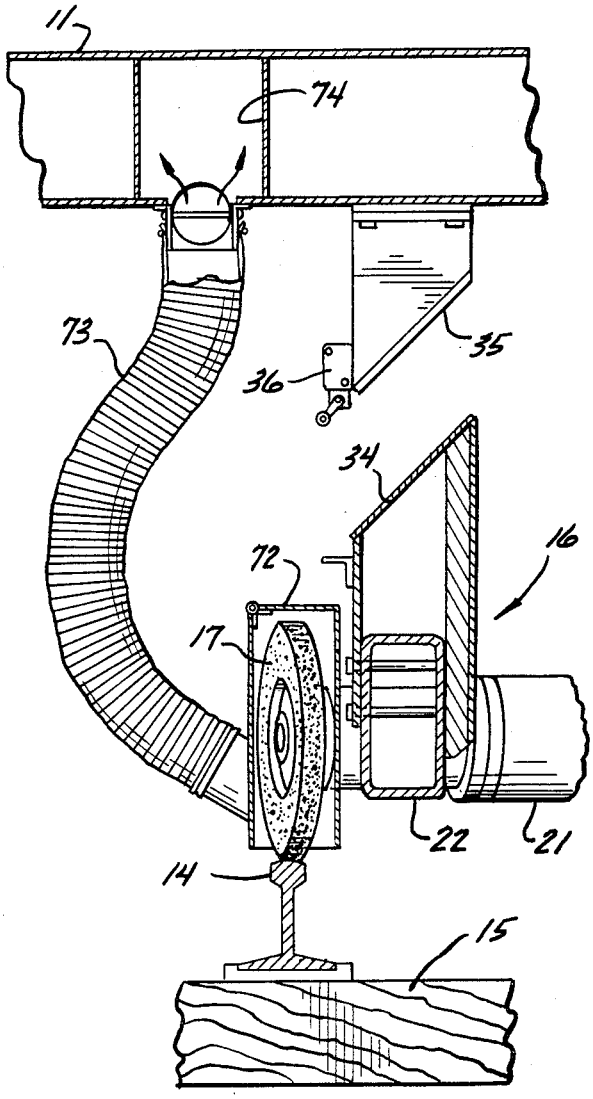
FIG. 7 is a partial section taken approximately along the line 7—7 in FIG. 4.

The beams 22 on opposite sides of the car 10 are connected by cross brackets 28, and the entire subframe is suspended at the corners by actuators 29. The upper ends of the actuators 29 carry stops 31 which ride in lost motion cylinders 32. When grinding, the length of the actuators 29 is set so that the stops 31 are midway in the cylinders 32 so that the subframe 16 can float on the track. For travel, the actuators 29 are shortened so that the stops 31 are bottomed in the cylinders 32, a condition sensed by limit switches 33, and the subframe 16 is thereafter lifted until plates 34 on the subframe abut plates 35 on the car frame 11, a condition sensed by limit switches 36. The subframe 16 can be locked in travel position by causing actuators 37 to move pins 38 through holes 39 in metal straps 41 hanging from the car frame 11. When the subassembly 16 is lowered into grinding position, the pins 38 ride in slots (see FIG. 4) in the straps 41.

The horizontal position of the beam 22 is controlled by an actuator 45 so that the stones 17 can be accurately positioned over the rail. The vertical position of the beam 22 is controlled, when grinding, by actuators 46 at the boom ends which react down on slides 47 which ride on the rail heads. The slides 47 are supported on the ends of the beam 22 by parallelogram linkages 48. The weight of the stones 17 and their motors 21 is normally greater than the desired grinding force so that the actuators 46, in effect, lift the ends of the beam 22 from the underlying rail 14.

In carrying out the invention, the horizontal stones 19 subframes 18 include a mounting frame 51 with arms 52 extending down close to the rail 14. Brackets 53 are pivoted on opposite sides of the lower ends of the arms 52, and each bracket 53 carries one of the stones 19 and its respective driving motor 54. Actuators 55 connected between the tops of the brackets 53 and cross brackets 56 coupling the subframes 18 allow each of the stones 19 to be individually angled in a plane normal to the rail 14. In this way, each of the four stones of each subframe assembly 18 can be adjusted to grind a different portion of the upper rail head contour, or two or more stones can be similarly angled to work on the same area.

The vertical position of the stones 19, and hence the grinding pressures developed, are controlled both by common actuators 57 which support the entire frame 51, and by individual stone controlling actuators 58 mounting each of the stone 19-motor 54 units. These units are secured to the cylinders of the actuators 58, and the pistons 59 of the actuators 58 have their ends fixed to the top and bottom portions of the brackets 53. Hydraulic pressure above or below the pistons 19 will urge the stones up or down on the brackets 53.

It is conventional to monitor the loads on rail grinding motors through the electrical power being used, and to vary the grinding stone pressure in response to load changes. In other words, if power draw increases, the stone can be urged upwardly relieving the stone pressure on the rail head and thus reducing the motor power requirement. The disclosed apparatus permits the average motor load of each set of four motors to control one of the actuators 57 so as to adjust grinding pressures. Alternatively, the presence of the actuators 58 allows each stone to be individually controlled in response to motor load, or in response to rail profile as measured by any suitable apparatus. Moreover, a combination of control is made possible by the actuators 57, 58 such as controlling the actuators 57 from the average motor loads and then monitoring the leading and trailing motors for load variations from the average—as might be encountered when grinding a long wave—and using such variations to control the actuators 58 for the leading and trailing stones.

It should also be noted that this flexibility in vertical control has been achieved while maintaining the ability to control, remotely rather than by direct mechanical adjustment, the transverse inclination of the stones. Remote inclination control permits stone adjustment guided by any suitable rail head contour reading apparatus.

Figure 15:
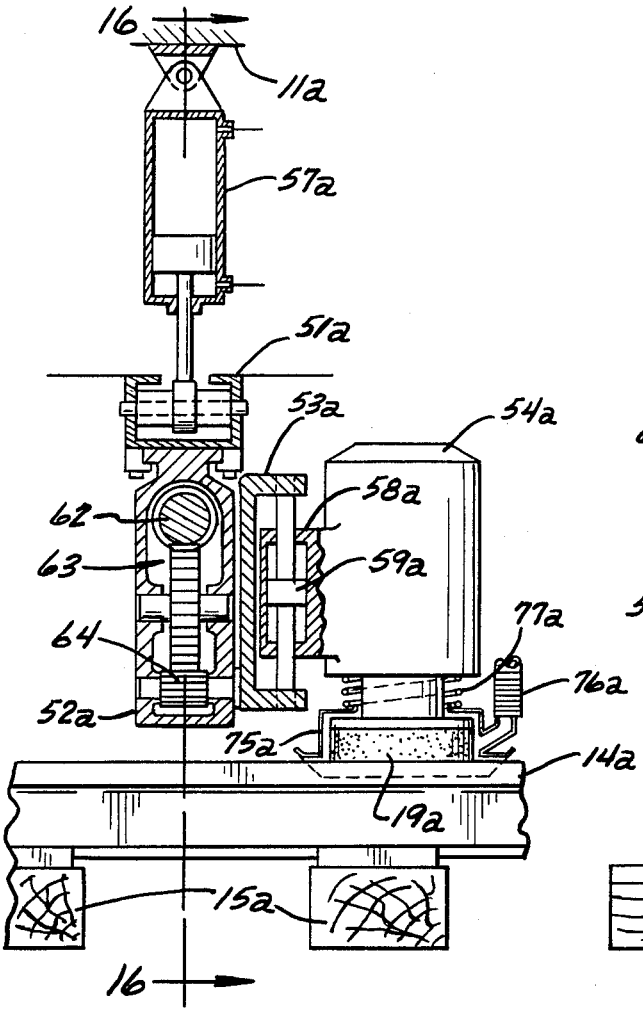
FIG. 15 is a side elevation, partially sectioned, of an alternate mechanism for mounting a horizontal grinding stone.
Figure 16:
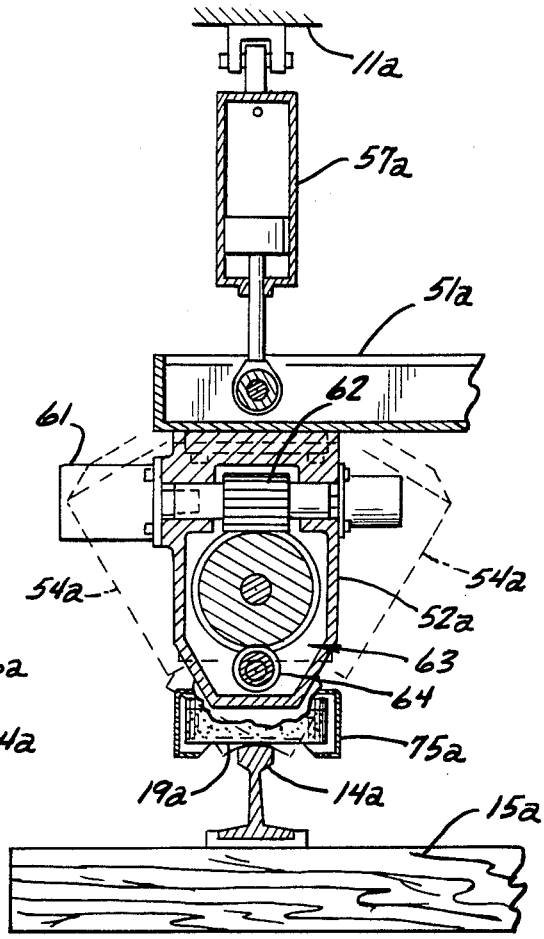
FIG. 16 is a section taken approximately along the 16—16 in FIG. 15.

An alternate mechanism for tilting the horizontal stones is shown in FIGS. 15 and 16 wherein parts previously described have been given the same reference numeral with the distinguishing suffix a added. Here, a reversible electric motor 61 drives the screw 62 of a worm gear set 63 geared to a pinion 64 that is on the shaft pivoting the bracket 53*a* on the lower end of the arm 52*a* of the mounting frame 51*a*. Rotation of the motor 61 in one direction or the other has the effect of turning the pinion 64 and angularly adjusting the position of the stone 19*a*, together with its driving motor 54*a*, relative to the rail 14*a*.

As a feature of the invention, grinding dust and sparks are contained by shrouds surrounding the grinding sides of the stones 17, 19 and a vacuum system draws the dust to a receptacle 70. The receptacle 70 is mounted in the car frame 11 and provided with a lower hopper door 71 for dumping and discarding its contents. The vertical stones 17 are enclosed by a rectangular box-like shroud 72 mounted on the slides 47. A pair of flexible hoses 73 open into the shroud 72 and connect to a duct 74 in the car frame 11 running to the receptacle 70 and connecting to a vacuum producing pump, not shown. The shroud 72 not only contains and draws away grinding dust and sparks from the grinding regions but also serves as a form of safety device in the event one of the grinding stones shatters, since the shroud would prevent pieces of stone from scattering.

Figure 8:
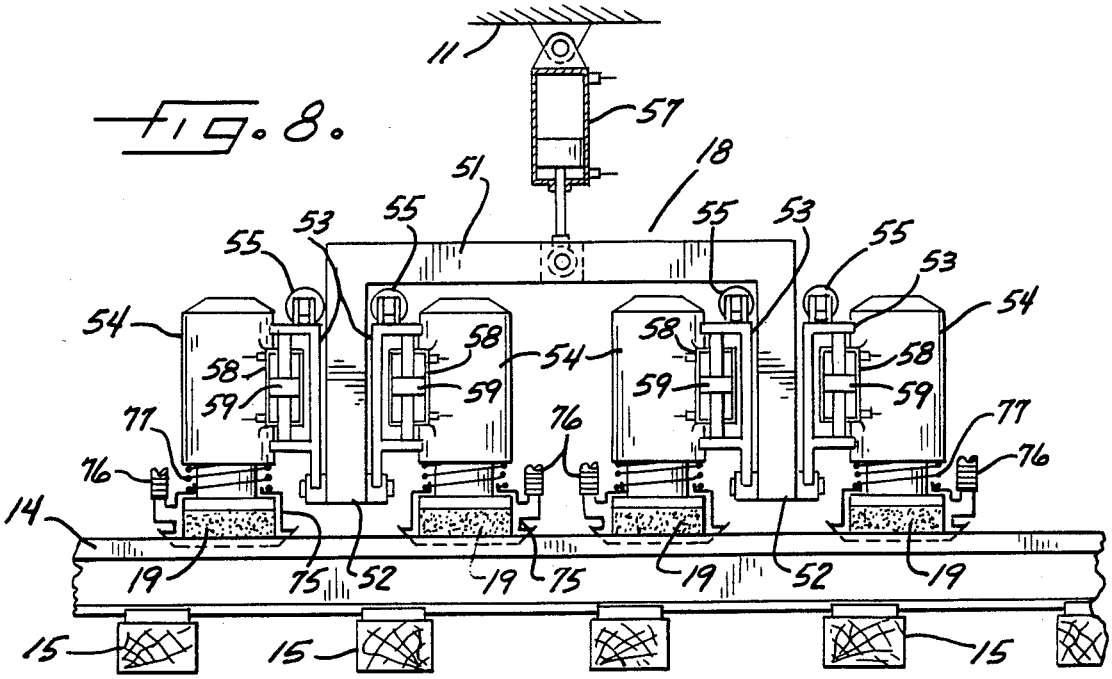
FIG. 8 is a somewhat diagrammatic side elevation of the horizontal grinding stones shown in FIG. 1.
Figure 9:
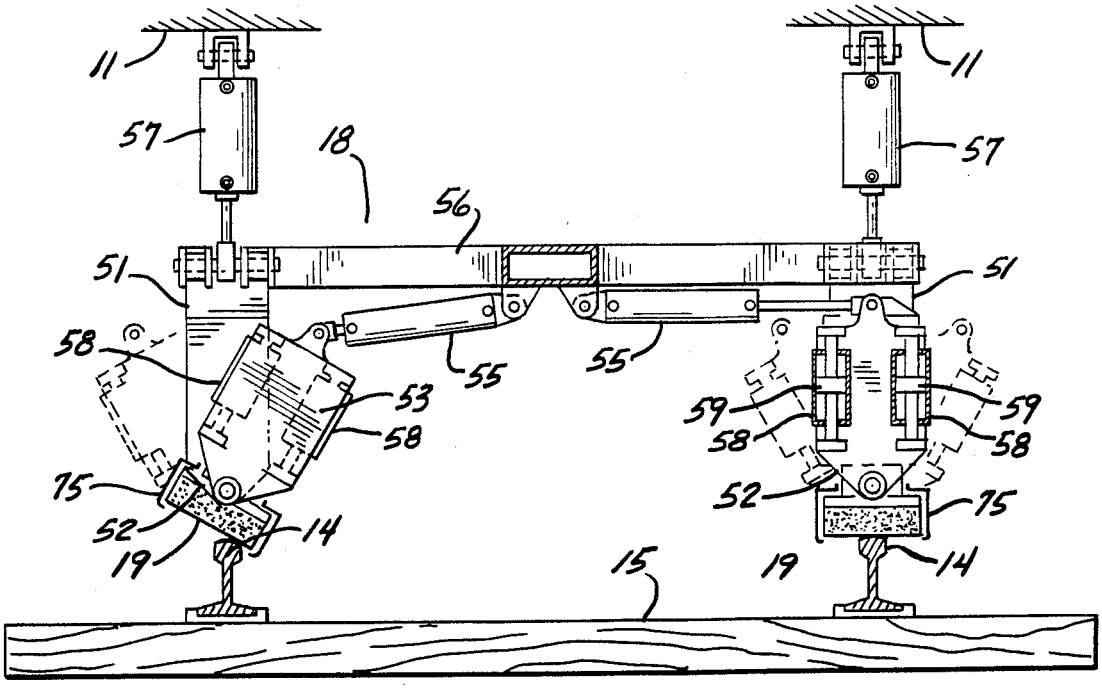
FIG. 9 is an end elevation of the grinding stone shown in FIG. 8.
Figure 11:
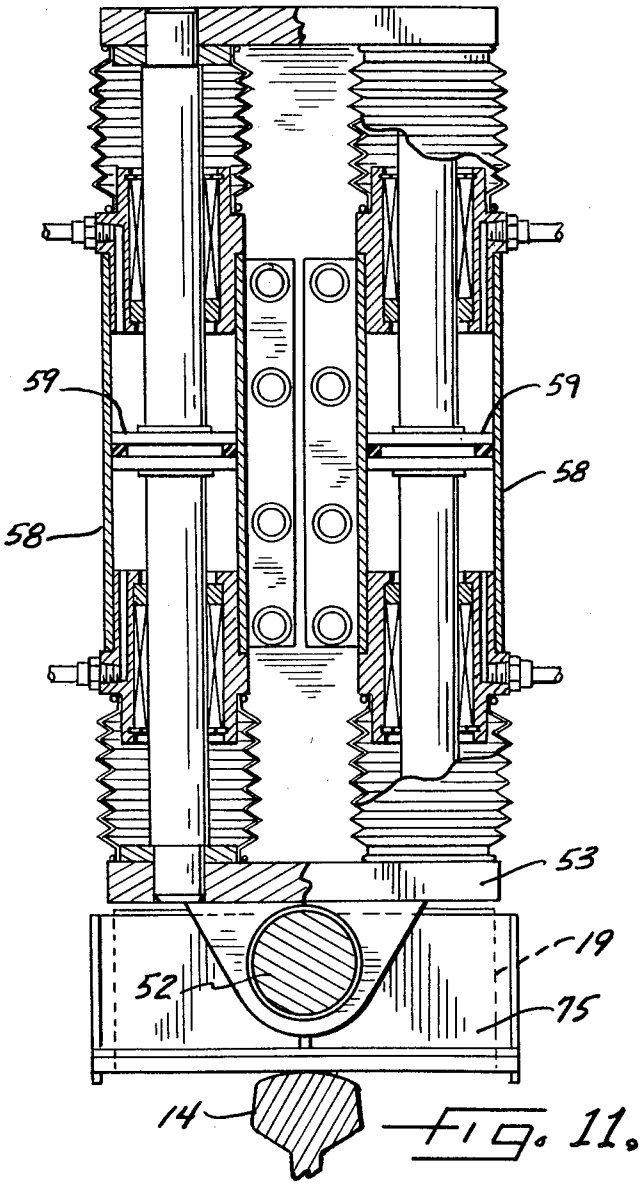
FIG. 11 is a section taken approximately along the line 11—11 in FIG. 10.
Figure 10:
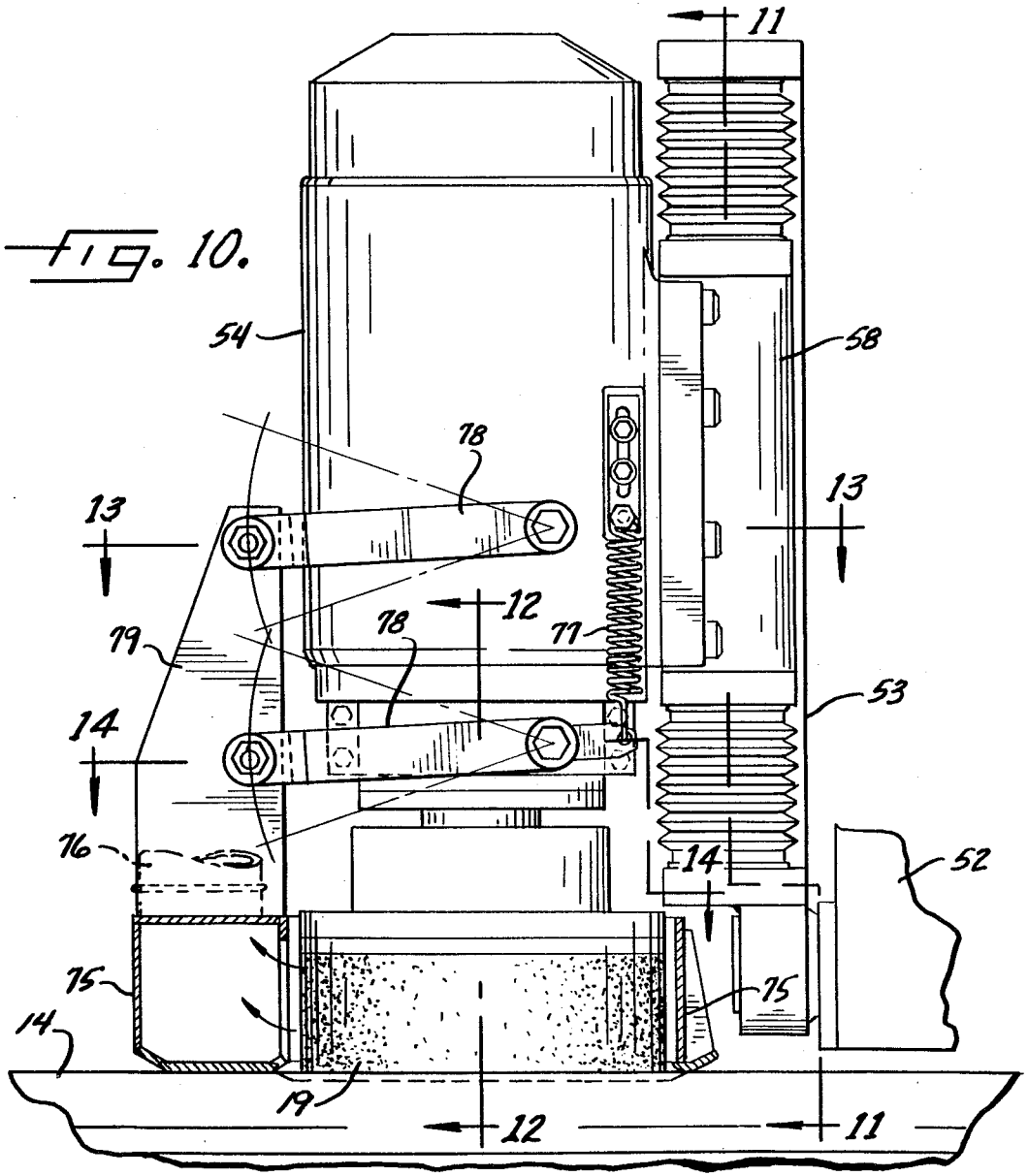
FIG. 10 is an enlarged fragmentary side elevation of one of the horizontal grinding stones shown in FIG. 1.
Figure 12:
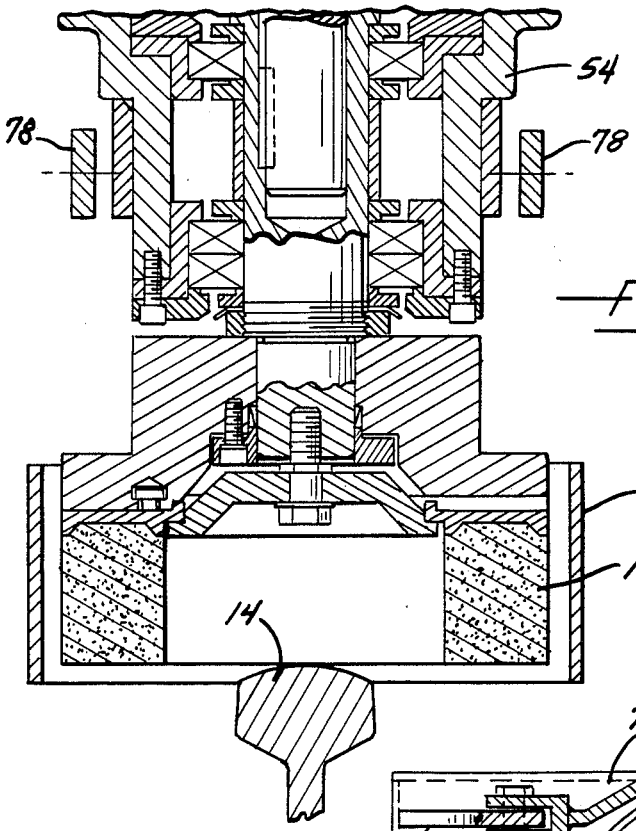
FIG. 12 is a section taken approximately along the line 12—12 in FIG. 10.
Figure 13:
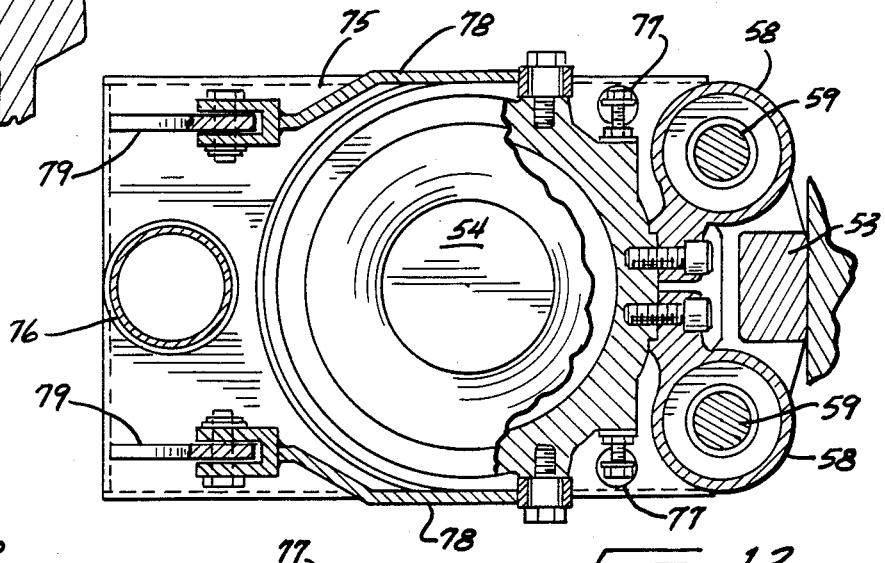
FIG. 13 is a section taken approximately along the line 13—13 in FIG. 10.
Figure 14:
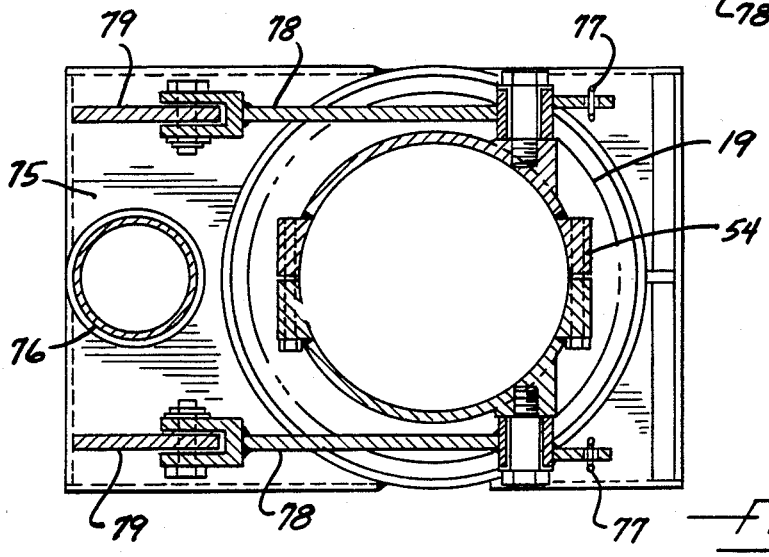
FIG. 14 is a section taken approximately along the line 14—14 in FIG. 10.

The horizontal stones are enclosed by individual annular shrouds 75 each connected by a flexible hose 76 to the duct 74. The shrouds 75 slide on the head of the rails 14 and are biased downwardly by springs 77, diagrammatically shown in FIG. 8. As illustrated in FIGS. 10 and 12–14, the shrouds 75 are supported by parallelogram links 78 and lugs 79, which hold the shrouds level but allow vertical movement, and the springs 77 act on one of the links 78.

It can now be seen that the car 10 utilizes both vertical and horizontal grinding stones for most efficient rail grinding. The vertical stones, which cut more rapidly, are utilized to smooth out upper rail surface wave deformations, whereas the horizontal stones, all independently positionable, can be angled where rail head profile corrections are necessary. The shrouds 72, 75 not only control sparks and abrasive grinding dust, but also serve as safety shields to prevent injury in the event of a stone disintegrating.

I claim as my invention:

1. A railroad track rail grinding car comprising, in combination, a frame supported on flanged wheels for running on railroad track, a first subframe mounted on said frame for movement from a raised travel position to a working position near a rail, a plurality of vertical grinding stones mounted on said first subframe for contacting and grinding the upper level of the rail, said vertical grinding stones having their axes canted from right angles of the rail so that stone-rail contact is not perpendicular to the centerline of the rail head, a second subframe mounted on said frame for movement from a raised travel position to a working position near said rail, a plurality of horizontal grinding stones mounted on said second subframe for contacting and grinding the head of said rail, means for individually positioning the grinding angle of each of said horizontal stones in planes normal to the rail, said vertical grinding stones defining a grinding path and said first subframe including an elongated resilient beam, an actuator coupled to lugs on the opposite ends of said beam for bending the beam in a horizontal plane so as to horizontally curve said grinding path, and a second actuator coupled to lugs on the opposite ends of said beam for bending said beam in a vertical plane so as to vertically curve said grinding path.

2. The combination of claim 1 including metal shrouds surrounding the grinding sides of said stones, said shrouds being mounted to slide along the top of rails when the stones are in grinding contact with the rails, a receptacle for grinding dust mounted on said frame, and means for vacuum drawing dust and sparks from said shrouds and to said receptacle.

3. A subframe assembly for mounting railroad track rail grinding stones comprising, in combination, an elongated resilient beam, a plurality of grinding stones arranged in fixed relation on said beam to define a grinding path paralleling the long axis of said beam, an actuator coupled to lugs on the opposite ends of said beam for bending said beam in a horizontal plane so as to horizontally curve said grinding path, and a second actuator coupled to lugs on the opposite ends of said beam for bending said beam in a vertical plane so as to vertically curve said grinding path.

4. The combination of claim 3 in which said grinding stones are vertically oriented and said vertical grinding stones have their axes canted from right angles of the rail so that stone-rail contact is not parallel to the axes of stone rotation.

5. The combination of claim 3 including, a metal shroud surrounding the tops and sides of said stones, said shroud being mounted to slide along the top of the rail when the stones are in grindng contact with the rails, a receptacle for grinding dust mounted on said frame, and means for vacuum drawing dust and sparks from said shroud and to said receptacle.

6. A subframe assembly for mounting railroad track rail grinding stones comprising, in combination, an elongated resilient beam, a plurality of vertical grinding stones journaled in fixed relation on said beam to define a grinding path paralleling the long axis of said beam, and an actuator coupled to lugs on the opposite ends of said beam for bending said beam so as to horizontally curve said grinding path.

7. A subframe assembly for mounting railroad track rail grinding stones comprising, in combination, a mounting frame having depending arms for being positioned close to the rail head, a pair of brackets pivoted on opposite sides of said arms for tilting movement on an axis parallel to the rail head, a pair of grinding stones and driving motors each mounted on one of said brackets for engagement with the rail head, means for independently tiling said brackets and thus said stones about said axis to adjust the points of stone contact across the contour of the rail head, metal shrouds surrounding the grinding sides of said stones, said shrouds being mounted to slide along the top of rails when the stones are in grinding contact with the rails, a receptacle for grinding dust mounted on said frame, and means for vacuum drawing dust and sparks from said shrouds and to said receptacles.

8. In a railroad track rail grinding car having rail grinding stones carried on a frame adapted to travel along railroad track, the combination comprising, metal shrouds surrounding the grinding sides of said stones, said shrouds being mounted to slide along the top of rails when the stones are in grinding contact with the rails, a receptacle for grinding dust mounted on said frame, and means for vacuum drawing dust and spraks from said shrouds and to said receptacle.

* * * * *